US008028872B2

(12) United States Patent
Hamlin

(10) Patent No.: US 8,028,872 B2
(45) Date of Patent: Oct. 4, 2011

(54) UTILITY POCKET WITH MAGNETIC CLOSURE

(75) Inventor: Brian Hamlin, McKinney, TX (US)

(73) Assignee: OmniQuest Ltd., McKinney, TX (US)

( * ) Notice: Subject to any disclaimer, the term of this patent is extended or adjusted under 35 U.S.C. 154(b) by 800 days.

(21) Appl. No.: 11/871,576

(22) Filed: Oct. 12, 2007

(65) Prior Publication Data

US 2009/0095751 A1 Apr. 16, 2009

(51) Int. Cl.
*A45F 5/00* (2006.01)
*A45F 3/04* (2006.01)

(52) U.S. Cl. ..... 224/183; 220/230; 224/274; 224/678; 224/679; 224/680; 224/681; 224/682; 224/683; 224/674

(58) Field of Classification Search ..... 224/183, 224/245, 199, 577, 929, 930, 904, 674, 678–684; 220/230; 206/818; 2/247, 251, 252
See application file for complete search history.

(56) References Cited

U.S. PATENT DOCUMENTS

| | | | | | |
|---|---|---|---|---|---|
| 2,784,757 | A | * | 3/1957 | Bosca et al. | 150/138 |
| 4,310,109 | A | | 1/1982 | Coyle | 224/230 |
| 5,351,868 | A | * | 10/1994 | Beletsky et al. | 224/245 |
| 5,692,835 | A | | 12/1997 | Krajeski | 383/22 |
| 6,070,628 | A | | 6/2000 | Natasi | 150/118 |
| 6,123,127 | A | | 9/2000 | Su | 150/116 |
| 6,328,191 | B1 | | 12/2001 | Conley et al. | 224/563 |
| 6,675,965 | B2 | | 1/2004 | Holland et al. | 206/338 |
| D500,203 | S | * | 12/2004 | Kim | D3/218 |
| 7,111,731 | B2 | | 9/2006 | Pratt et al. | 206/315.5 |
| D534,720 | S | * | 1/2007 | Infanti et al. | D3/218 |
| D538,034 | S | * | 3/2007 | Moghaddam | D3/218 |
| D564,752 | S | * | 3/2008 | Badillo et al. | D3/218 |
| D573,789 | S | * | 7/2008 | Eisenbraun | D3/218 |
| 2004/0206796 | A1 | * | 10/2004 | Badillo et al. | 224/577 |
| 2006/0183518 | A1 | * | 8/2006 | Emano | 455/575.8 |
| 2008/0041897 | A1 | * | 2/2008 | Malhotra | 224/199 |

* cited by examiner

*Primary Examiner* — Tri Mai
(74) *Attorney, Agent, or Firm* — Charles D. Gunter, Jr.

(57) ABSTRACT

A utility pocket is shown for use with a tool pouch or bag, or with such items as a brief case, soft sided cooler, or a backpack. The utility pocket has a clam shell shaped outer member which is biased toward an associated sidewall panel by means of elastic webbing. A pair of mating permanent magnets come into contact as the pocket moves from the open position to the closed position and help to bias the pocket to the closed position, as well as imparting a snap-closure action to the pocket. The material chosen for the pocket helps it to retain its clam shell shape without requiring internal reinforcing members, such as wire springs or other metal reinforcing elements.

10 Claims, 2 Drawing Sheets

UTILITY POCKET WITH MAGNETIC CLOSURE

BACKGROUND OF THE INVENTION

1. Field of the Invention

The present invention relates generally to utility pockets and pouches of the type found on tool bags, backpacks, brief cases, soft sided coolers and similar items, and more specifically to such a pocket having a magnetic closure feature.

2. Description of the Prior Art

Utility pockets are found on a wide variety of garments and work related apparel, as well as on such things as tool bags, backpacks, brief cases and soft sided coolers. Soft sided pockets were, in many instances, an improvement over the traditional hard sided tool boxes of the type used in the building trades. The traditional hard bodied tool box typically included either metal or hard plastic bodies that have a hinged top and a small removable tray that lifts out to reveal the inner confines of the box for bulk tool storage. Some of the prior art designs have small mounted drawers either in the top or the bottom for smaller tools or loose fasteners. Since these boxes are made of metal, hard plastic or rubber, they often do not conform to unique storage and use situations in real life trade applications.

In addition, most of such prior art designs of the type used for transporting tools and other building materials to a job site, were tedious and inefficient for a worker to use. They generally required a plumber, carpenter, or an electrician, to go back and forth from the tool box to pick up and drop off tools or building supplies or materials such as nails, screws, rivets, etc., while working on the job site. A more efficient way of accessing tools or building materials on the job site would be to load the tools or related items or supplies into an article worn on the body. Some workers have used aprons or vests with storage pockets, while others have utilized tool belts to accomplish these types of tasks.

Whether the item is one which is worn on the body such as a tool bag or pouch, or whether it is a backpack, brief case, soft sided cooler bag, or similar item, a need exists for an improved utility pocket for such items. In the case of a tool belt, the belt may have different receptacles and compartments for holding differently-shaped tools, building materials, supplies and accessories. One helpful accessory for such a tool belt is a pocket that serves as a small-parts organizer for objects such as nails, screws, bolts, fasteners, wires, nuts, and other objects that workers need in a large quantity of at the work site.

A need exists for such a utility pocket which is simple in design and economical to manufacture and which can easily be incorporated into existing tool bag designs, as well as into existing backpacks, brief cases, coolers, and similar items. In the example of a brief case, the pocket might be used to hold a cell phone, office accessories such as paper clips, stick-on note pads, etc. In the case of the backpack, the pocket might hold any number of camping, hiking or outdoor type accessory items, such as a compass, snack foods, a pen knife, matches, etc.

A need exists for such a utility pocket design, for any of the above noted end applications, which can be accessed with either the left or right hand and which features a magnetic closure to automatically bias the pocket opening to the closed position once the interior contents of the pocket have been accessed.

A need exists for such a design which presents an attractive appearance on a variety of different product lines whether for a consumer item such as a briefcase of backpack, or whether used on more of a utility item such as a tool bag or pouch.

SUMMARY OF THE INVENTION

The present invention is a utility pocket for an accessory item where the accessory item has at least one sidewall panel for receiving the pocket. The improved pocket of the invention includes a relatively rigid outer clam shell member, formed of a course fabric, having an arcuate shaped front panel portion with opposing side panels. The outer clam shell member also has a top edge, a bottom edge and opposing side edges. The bottom edge of the clam shell member is attached to the sidewall panel of the accessory item by sewing the bottom edge to the sidewall panel, thereby creating a flexible hinge region for the pocket. The clam shell member has an underside which, together with the sidewall panel, forms an interior region of the pocket.

A length of elastic webbing connects an underside of each of the opposing side panels of the clam shell member to the sidewall panel of the accessory item. The respective lengths of webbing serve to bias the clam shell member between an open position which places the webbing in tension, and a normally relaxed and closed position. The open position of the clam shell member forms a pocket opening which allows access to an underside of the clam shell member and thus to the interior region of the pocket.

The sidewall panel of the item has a permanent magnet located thereon. The clam shell member also has a permanent magnet mounted thereon in an upper interior region of the member, contact between the panel magnet and the magnet on the clam shell member serving to retain the pocket in the closed position.

The course nature of the fabric which is selected for the material used to form the clam shell member results in its retaining its arcuate shape without the presence of such additional structural members as metal reinforcing members sewn into the fabric. Preferably, the shell member is formed of 500-700 Denier polyester fabric. Most preferably, the clam shell member is formed of 600 Denier polyester fabric.

The top edge of the clam shell member is also preferably provided with a downwardly facing handle secured thereto on an exterior surface thereof. The downwardly facing handle can be formed having a fabric cover and having a length of hard plastic sheeting contained within the cover, the hard plastic sheeting serving to further reinforce the shape of the clam shell member.

The pocket is accessed from either left or right hand sides by simply grasping the handle and pulling with enough force to overcome the inherent bias of the elastic webbing, plus the force exerted by the contact between the permanent magnets. In the normally closed position of the pocket, the magnets are engaged and exert an additional bias which tends to resist movement of the clam shell member in a direction away from the sidewall panel of the item, thereby helping to ensure that the pocket stays in the closed position so that items contained within the pocket interior tend to remain in place.

Additional objects, features and advantages will be apparent in the written description which follows.

DETAILED DESCRIPTION OF THE INVENTION

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

Figure 1:
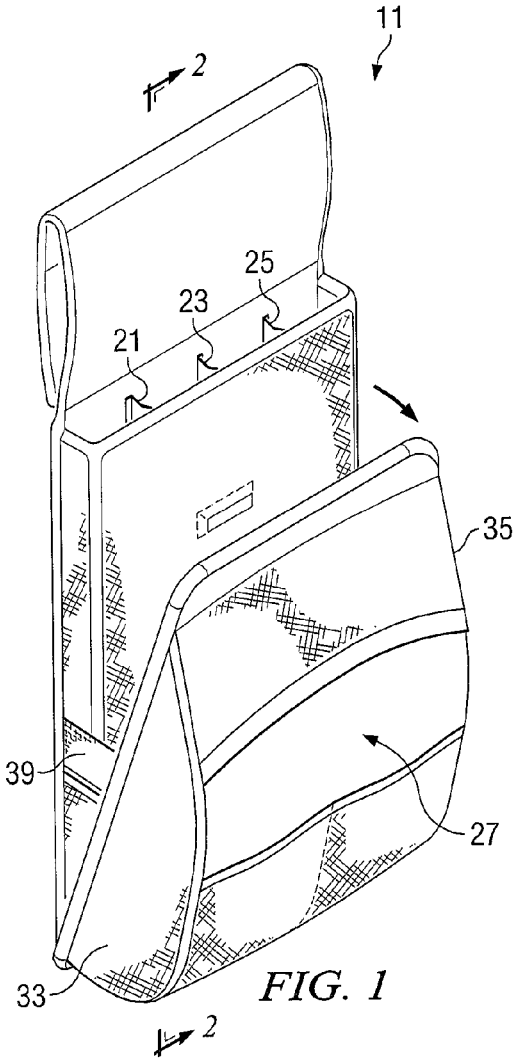
FIG. 1 is a perspective view of a utility pocket of the invention, in this case mounted on the sidewall panel of a utility pouch of the type which might be worn on the belt of a worker.
Figure 2:
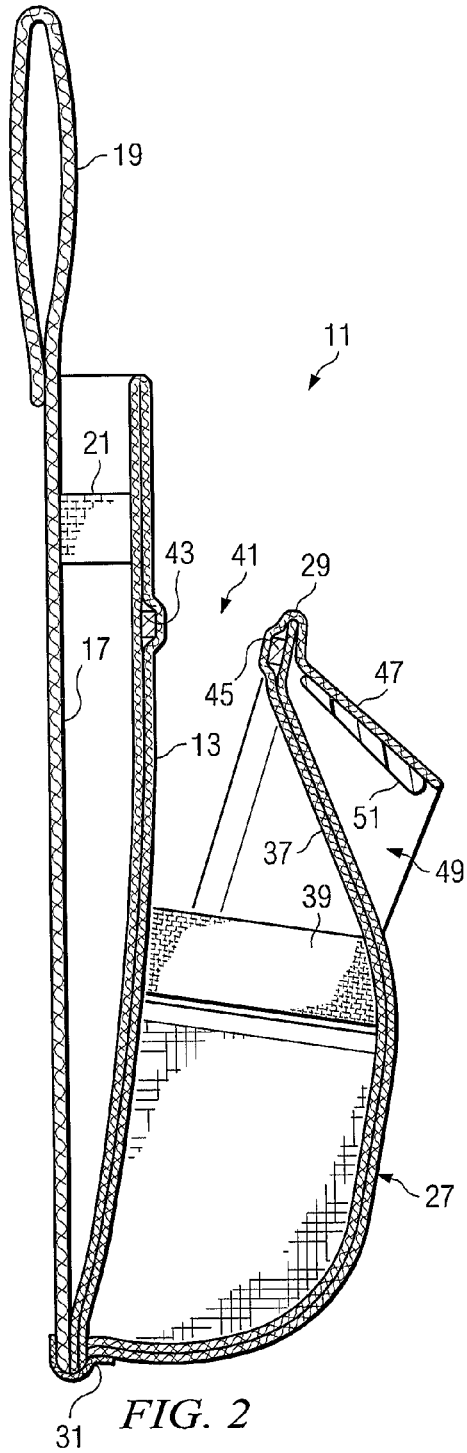
FIG. 2 is a side, partial cross sectional view of the pouch of FIG. 1, showing the elastic webbing and permanent magnets which function to provide the snap action closure for the pocket.

FIGS. 1 and 2 show the utility pocket of the invention designated generally as 11. The utility pocket 11 is designed to be used with an "accessory item" having at least one sidewall panel. By "accessory item" is meant, for example, a belt worn pouch such as shown in FIG. 1 or a tool bag such as that shown in FIG. 3. The tool pouch of FIG. 1 is of a style typically worn by a carpenter, electrician or other worker about the waist on a belt. The soft sided tool bag shown in FIG. 3 could also be used in a variety of trade applications.

Figure 3:
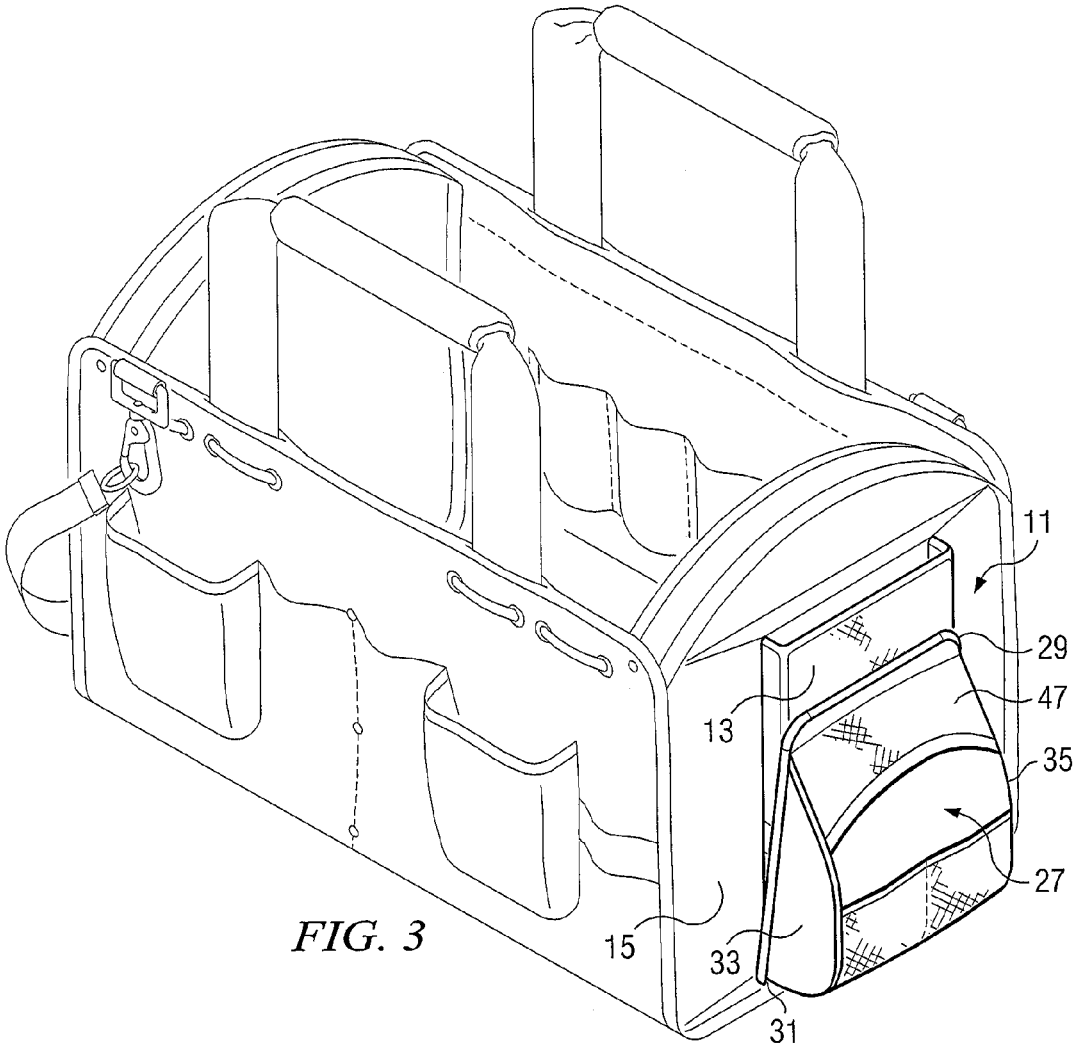
FIG. 3 is a simplified, perspective view of the utility pocket of the invention, in this case mounted on the sidewall panel of a tool bag.

In both of the examples illustrated in the drawings, the "accessory item" has at least one sidewall panel, such as the panels 13, 15 shown in FIGS. 2 and 3 of the drawings. In the example of the pouch shown in FIG. 2, the pouch has an outer panel 13 which overlies an inner panel 17, the inner panel terminating at the top in a belt loop 19. In the example of FIG. 2, the inner and outer panels 13, 17 are supported in spaced relationship by one or more vertically arranged dividers 21, 23, 25.

As shown in FIGS. 1 and 2, the utility pocket 11 includes a relatively rigid outer "clam shell" member 27. The clam shell member 27 is formed of a course fabric material, typically a polyester fabric of 500-700 Denier weave. Most preferably, the clam shell member 27 is formed of a 600 Denier polyester fabric.

The relatively rigid outer clam shell member 27 has a top edge 29, a bottom edge 31 and opposing side edges 33, 35. The bottom edge 31 (FIG. 2) of the clam shell member is attached to the sidewall panel 13 of the accessory item by sewing the bottom edge to the sidewall panel, thereby creating a flexible hinge region for the pocket. As shown in FIG. 2, the clam shell member 27 has an underside 37 which, together with the front sidewall panel 13 forms an interior region of the pocket.

A length of elastic webbing, such as the length of webbing 39 shown in FIG. 2, connects an underside of each of the opposing side panels 33, 35 of the clam shell member to the sidewall panel 13 of the accessory item. The respective lengths of webbing 39 server to bias the clam shell member between the open position shown in FIG. 2 which places the webbing in tension, and a normally relaxed and closed position (see FIG. 3). The open position of the clam shell member forms a pocket opening (generally at 41 in FIG. 1) which allows the access to the underside 37 of the clam shell member and thus to the interior region of the pocket.

As best seen in FIGS. 1 and 2, the sidewall panel 13 of the accessory item has located thereon a permanent magnet 43. The clam shell member also has a permanent magnet 45 mounted thereon in an upper interior region of the member which aligns with the position of the panel magnet 43 as the pocket moves from the open to the closed position. Contact between the panel magnet 43 and the magnet 45 on the clam shell member serves to retain the pocket in the closed position shown in FIG. 3. The magnets can be attached to the panel and clam shell member in any appropriate fashion, for example by sewing them within a small flap of the fabric material. They could also be glued or otherwise adhered to the panel and clam shell member.

The permanent magnet 43 which is located in the sidewall panel of the item and the permanent magnet 45 located in the upper region of the clam shell member engage when the pocket is in the closed position shown in FIG. 3 and exert an additional bias which tends to resist movement of the clam shell member 27 in a direction away from the sidewall panel 13 of the item, thereby helping to insure that the pocket stays in the closed position shown in FIG. 3 so that items contained within the pocket interior tend to remain in place. The attraction between an action of the permanent magnets in making contact also imparts a sort of "two-part snap action" to the closure and retention function of the pocket. In other words, the elastic webbing 39 naturally exerts a force which tends to move the pocket from the open to the closed position. The magnets, however, began to exert attractive forces prior to the fully closed position of the pocket, giving it a definite snap-to closing action as the pocket fully closes.

Another unique aspect of the pocket of the invention is the fact that the course nature of the fabric chosen for the clam shell member 27, in addition to certain other structural features of the fabric, results in retaining the arcuate shape of the clam shell without the presence of metal reinforcing members sewn into the fabric. This results not only in economy of manufacture but also in the provision of a finished item which is attractive in appearance and which does not present sharp edges or run the risk of metal fatigue despite numerous opening and closing actions of the pocket.

As shown in FIG. 2, the top edge 29 of the clam shell member 27 can also be provided with a downwardly facing handle region 47 which presents a downwardly facing finger engaging pocket region 49. The downwardly facing handle region 47 has a fabric cover and can also have a length of hard plastic sheeting 51 contained within the cover. The generally rectangular shaped length of hard plastic sheeting 51 serves to further reinforce the shape of the clam shell member without the need for bent wires, springs or other metal reinforcement.

An invention has been provided with several advantages. The utility pocket of the invention can be used with a variety of different types of accessory items including soft sided tool boxes and pouches, soft sided coolers, briefcases, back packs and the like. The pocket is attractive in appearance and provides a unique "snap type action" which biases the pocket toward the closed position and assists in closing and retaining the pocket contents. The clam shell appearance of the outer pocket retains its shape without the necessity of internal metal reinforcing elements. The pocket is simple in design and economical to manufacture and can be used in a wide variety of applications by simply shifting the outer clam shell member to the sidewall panel of the item of interest.

While the invention has been shown in only two of its forms, it is not thus limited but is susceptible to various changes and modifications without departing from the spirit thereof.

What is claimed is:

1. A utility pocket for a tool bag, the utility pocket having closure and retention functions and having at least one external sidewall panel, the pocket comprising:

a relatively rigid outer clam shell member, formed of a course fabric, having an arcuate shaped front panel portion with opposing side panels, the outer clam shell member also having a top edge, a bottom edge and opposing side edges, the bottom edge of the clam shell member being attached to the sidewall panel of the accessory item by sewing the bottom edge to the sidewall panel, thereby creating a flexible hinge region for the pocket, the clam shell member having an underside which, together with the sidewall panel, forms an initially totally enclosed interior region of the pocket;

a length of elastic webbing connecting an underside of each of the opposing side panels of the clam shell member to the sidewall panel of the accessory item, the respective lengths of webbing serving to bias the clam shell member between an open position which places the webbing in tension, and a normally relaxed and closed position, the open position of the clam shell member forming a pocket opening which allows access to an underside of the clam shell member and thus to the initially totally enclosed interior region of the pocket, and wherein the bottom edge of the clam shell member together with the top edge and opposing side edges contact the sidewall panel in the closed position, thereby defining a continuous perimeter of contact which creates the initially totally enclosed interior region of the pocket;

wherein the sidewall panel of the item has located thereon a permanent magnet, and wherein the clam shell member also has a permanent magnet mounted thereon in an upper interior region of the member, wherein a magnetic attraction exists between the panel magnet and the magnet on the clam shell member, the bias provided by the length of webbing together with the magnetic attraction serving to impart a two-part snap action to the closure and retention functions of the pocket, contact between the panel magnet and the magnet on the clam shell member serving to retain the pocket in the closed position.

2. The utility pocket of claim 1, wherein the clam shell member is formed of 500-700 Denier polyester fabric.

3. The utility pocket of claim 1, wherein the clam shell member is formed of 600 Denier polyester fabric.

4. The utility pocket of claim 1, wherein the course nature of the fabric chosen for the clam shell member results in it retaining its arcuate shape without the presence of metal reinforcing members sewn into the fabric.

5. A utility pocket for an accessory item having at least one sidewall panel, the pocket comprising:

a relatively rigid outer clam shell member, formed of a course fabric, having an arcuate shaped front panel portion with opposing side panels, the outer clam shell member also having a top edge, a bottom edge and opposing side edges, the bottom edge of the clam shell member being attached to the sidewall panel of the accessory item by sewing the bottom edge to the sidewall panel, thereby creating a flexible hinge region for the pocket, the clam shell member having an underside which, together with the sidewall panel, forms an interior region of the pocket;

a length of elastic webbing connecting an underside of each of the opposing side panels of the clam shell member to the sidewall panel of the accessory item, the respective lengths of webbing serving to bias the clam shell member between an open position which places the webbing in tension, and a normally relaxed and closed position, the open position of the clam shell member forming a pocket opening which allows access to an underside of the clam shell member and thus to the interior region of the pocket;

wherein the sidewall panel of the item has located thereon a permanent magnet, and wherein the clam shell member also has a permanent magnet mounted thereon in an upper interior region of the member, contact between the panel magnet and the magnet on the clam shell member serving to retain the pocket in the closed position; and wherein the top edge of the clam shell member has a downwardly facing handle secured thereto on an exterior surface thereof, the downwardly facing handle having a fabric cover and having a length of hard plastic sheeting contained within the cover, the hard plastic sheeting serving to further reinforce the shape of the clam shell member.

6. The utility pocket of claim 5, wherein the permanent magnet which is located in the sidewall panel of the item and the permanent magnet located in the upper region of the clam shell member engage when the pocket is in the closed position and exert an additional bias which tends to resist movement of the clam shell member in a direction away from the sidewall panel of the item, thereby helping to ensure that the pocket stays in the closed position so that items contained within the pocket interior tend to remain in place.

7. A method for facilitating retention of and access to items in a pocket of a bag or pouch, the method comprising the steps of:

providing a bag or pouch with a utility pocket having closure and retention functions, the pocket including a relatively rigid outer clam shell member, formed of a course fabric, having an arcuate shaped front panel portion with opposing side panels, the outer clam shell member also having a top edge, a bottom edge and opposing side edges, the bottom edge of the clam shell member being attached to the sidewall panel of the accessory item by sewing the bottom edge to the sidewall panel, thereby creating a flexible hinge region for the pocket, the clam shell member having an underside which, together with the sidewall panel, forms an initially totally enclosed interior region of the pocket for receiving and retaining items of interest;

providing the pocket with a length of elastic webbing connecting an underside of each of the opposing side panels of the clam shell member to the sidewall panel of the accessory item, the respective lengths of webbing serving to bias the clam shell member between an open position which places the webbing in tension, and a normally relaxed and closed position, the open position of the clam shell member forming a pocket opening which allows access to an underside of the clam shell member and thus to the initially totally enclosed interior region of the pocket, and wherein the bottom edge of the clam shell member together with the top edge and opposing side edges contact the sidewall panel in the closed position, thereby defining a continuous perimeter of contact which creates the initially totally enclosed interior region of the pocket;

wherein the sidewall panel of the item has located thereon a permanent magnet, and wherein the clam shell member also has a permanent magnet mounted thereon in an upper interior region of the member wherein a magnetic attraction exists between the panel magnet and the magnet on the clam shell member, the bias provided by the length of webbing together with the magnetic attraction serving to impart a two-part snap action to the closure and retention functions of the pocket; and whereby the initially totally enclosed interior region of the pocket may be accessed by a single hand of a user from either the left or right hand sides and wherein the combined action of the webbing and contact between the panel magnet and the magnet on the clam shell member serves to automatically close and seal shut the pocket and thereby retain the pocket in the closed position.

8. The method of claim 7, wherein the pocket is formed of a selected fabric material, and wherein a course fabric is chosen for the pocket fabric material, the course nature of the fabric material serving to retain the arcuate shape of the clam shell without the presence of metal reinforcing members sewn into the fabric.

9. The method of claim 8, wherein the fabric selected for the pocket material is 500-700 Denier polyester fabric.

10. A method for facilitating retention of and access to items in a pocket of a bag or pouch, the method comprising the steps of:

providing a bag or pouch with a utility pocket, the pocket including a relatively rigid outer clam shell member, formed of a course fabric, having an arcuate shaped front panel portion with opposing side panels, the outer clam shell member also having a top edge, a bottom edge and opposing side edges, the bottom edge of the clam shell member being attached to the sidewall panel of the accessory item by sewing the bottom edge to the sidewall panel, thereby creating a flexible hinge region for the pocket, the clam shell member having an underside which, together with the sidewall panel, forms an interior region of the pocket for receiving and retaining items of interest;

providing the pocket with a length of elastic webbing connecting an underside of each of the opposing side panels of the clam shell member to the sidewall panel of the accessory item, the respective lengths of webbing serving to bias the clam shell member between an open position which places the webbing in tension, and a normally relaxed and closed position, the open position of the clam shell member forming a pocket opening which allows access to an underside of the clam shell member and thus to the interior region of the pocket;

wherein the sidewall panel of the item has located thereon a permanent magnet, and wherein the clam shell member also has a permanent magnet mounted thereon in an upper interior region of the member;

wherein the combined action of the webbing and contact between the panel magnet and the magnet on the clam shell member serves to automatically close and seal shut the pocket and thereby retain the pocket in the closed position; and wherein the top edge of the clam shell member is provided with a downwardly facing handle secured thereto on an exterior surface thereof, the downwardly facing handle having a fabric cover and having a length of hard plastic sheeting contained within the cover, the hard plastic sheeting serving to further reinforce the shape of the clam shell member.

* * * * *